US008950885B2

(12) United States Patent
Pieper

(10) Patent No.: US 8,950,885 B2
(45) Date of Patent: Feb. 10, 2015

(54) FRAMELESS DOWNLIGHT

(75) Inventor: Stephan Pieper, Lemgo (DE)

(73) Assignee: Zumtobel Lighting GmbH (DE)

( * ) Notice: Subject to any disclaimer, the term of this patent is extended or adjusted under 35 U.S.C. 154(b) by 122 days.

(21) Appl. No.: 13/580,456

(22) PCT Filed: Feb. 23, 2011

(86) PCT No.: PCT/EP2011/052648

§ 371 (c)(1),
(2), (4) Date: Nov. 9, 2012

(87) PCT Pub. No.: WO2011/104255

PCT Pub. Date: Sep. 1, 2011

(65) Prior Publication Data

US 2013/0050994 A1 Feb. 28, 2013

(30) Foreign Application Priority Data

Feb. 23, 2010 (DE) ..... 20 2010 002 646 U

(51) Int. Cl.

| | |
|---|---|
| ***F21V 17/10*** | (2006.01) |
| ***F21V 21/04*** | (2006.01) |
| ***F21S 8/02*** | (2006.01) |
| ***F21V 7/00*** | (2006.01) |
| *F21V 29/00* | (2006.01) |
| *F21Y 101/02* | (2006.01) |

(52) U.S. Cl.

CPC ..... *F21S 8/026* (2013.01); *F21V 17/102* (2013.01); *F21V 21/04* (2013.01); *F21V 7/00* (2013.01); *F21V 29/004* (2013.01); *F21Y 2101/02* (2013.01)

USPC ..... 362/147; 362/364; 362/365

(58) Field of Classification Search

CPC ..... F21V 17/005; F21V 17/02; F21V 17/10; F21V 17/104; F21V 17/12; F21V 17/14; F21V 17/18; F21S 8/02; F21S 8/022; F21S 8/024; F21S 8/026

USPC ..... 362/147, 364, 365, 366, 404

See application file for complete search history.

(56) References Cited

U.S. PATENT DOCUMENTS 4,475,147 A * 10/1984 Kristofek ..... 362/148
4,930,054 A * 5/1990 Krebs ..... 362/147

(Continued)

FOREIGN PATENT DOCUMENTS

DE 4016531 A1 11/1991
EP 0127611 A2 12/1984

(Continued)

OTHER PUBLICATIONS

"International Application No. PCT/EP2011/052648, International Search Report dated Aug. 1, 2011", 5 pages.

(Continued)

*Primary Examiner* — Y M Lee

(74) *Attorney, Agent, or Firm* — Schwegman Lundberg & Woessner, P.A.

(57) ABSTRACT

A downlight comprises a light source for generating a light to be emitted downwards by the downlight, a mounting ring for retaining the downlight on a ceiling element, and a reflector for reflecting the light generated by the light source. A holding device which retains the reflector on the mounting ring is designed in such a way that the reflector is retained on the mounting ring merely by lying thereon.

13 Claims, 5 Drawing Sheets

(56) References Cited

U.S. PATENT DOCUMENTS

| | | | | |
|---|---|---|---|---|
| 8,220,970 | B1 * | 7/2012 | Khazi et al. | 362/364 |
| 2002/0109983 | A1 * | 8/2002 | Bonazzi | 362/147 |

FOREIGN PATENT DOCUMENTS

| | | | |
|---|---|---|---|
| EP | 0551610 | A1 | 7/1993 |
| EP | 1043542 | A2 | 10/2000 |

OTHER PUBLICATIONS

"International Application No. PCT/EP2011/052648, International Preliminary Report on Patentability dated Aug. 28, 2012", (w/ English Translation), 14 pgs.

"International Application No. PCT/EP2011/052648, Written Opinion dated Aug. 1, 2011", (w/ English Translation), 12 pgs.

* cited by examiner

FRAMELESS DOWNLIGHT

The invention relates to a downlight having a light source for generating a light to be emitted downwards by the downlight, a mounting ring for retaining the downlight on a ceiling element, and a reflector for reflecting the light generated by the light source, the reflector being retained on the mounting ring by a retaining device.

PRIORITY CLAIM TO RELATED APPLICATIONS

This application is a national stage application under 35 U.S.C. §371 of PCT/EP2011/052648, filed Feb. 23, 2011, and published as WO 2011/104255 A1 on Sep. 1, 2011, which claims priority to German Application No. 20 2010 002 646.6, filed Feb. 23, 2010, which applications and publication are incorporated by reference as if reproduced herein and made a part hereof in their entirety, and the benefit of priority of each of which is claimed herein.

The word "downlight" designates a light which is intended for attachment to a ceiling and is designed for a downward emission of light. The light in question may, in particular, be a recessed ceiling light which is intended to be installed in a circular aperture in a suspended ceiling element.

In a downlight of this kind, it is known practice to fix the reflector no the mounting ring with the aid of a bayonet connection. For undoing this connection, provision is made, under these circumstances, for the reflector to be pressed upwards with the aid of an outwardly protruding flange and for the bayonet connection then to be undone with the further application of pressure. It is therefore necessary for the reflector to have a flange of suitably large and sturdy design as the contact surface. When the downlight is viewed from below, the flange accordingly appears as an annular structure. This restricts the design possibilities for the downlight with regard to its outward appearance.

The underlying object of the invention is to indicate a downlight which offers improved design possibilities with regard to its outward appearance.

This object is achieved, according to the invention, by means of the downlight mentioned in the independent claim. Particular methods of embodiment of the invention are indicated in the dependent claims.

According to the invention, a downlight is provided which has a light source for generating a light to be emitted downwards by the downlight, a mounting ring for retaining the downlight on a ceiling element, and a reflector for reflecting the light generated by the light source, the reflector being retained on the mounting ring by a retaining device. The retaining device here is constructed in such a way that the reflector is retained merely by resting on the mounting ring.

What is made possible by this retaining device is that the reflector merely has to be lifted up for detachment purposes, but does not have to be pressed. Through the fact that no pressure has to be exerted on the reflector, it is possible to dispense with a correspondingly broad flange, such as is known from the prior art. The reflector may, for example, be lifted up by being directly supported on an inwardly-pointing reflecting surface, without there being any appreciable risk of the said surface being damaged in the process. The design possibilities for the downlight with regard to its outward appearance are thus improved.

The mounting ring preferably has a bearing unit and the reflector a supporting unit, the bearing unit and supporting unit being parts of the retaining device and the reflector being retained on the mounting ring through the fact that the supporting unit rests on the bearing unit. This makes possible a particularly simple design of the retaining device.

The bearing unit preferably has a bearing surface for at least part of the supporting unit, the retaining device being designed in such a way that the reflector can be retained in a number of different positions relative to the mounting ring. This makes it possible easily to position the reflector in different positions relative to the mounting ring.

Under these circumstances, the bearing surface preferably has a slight inclination, preferably of less than 3°. In this way, simple vertical adjustment of the reflector in relation to the mounting ring is provided. It is therefore possible, for example, after installing the downlight in the ceiling element, to compensate for manufacture-induced or installation-induced inaccuracies with reference to an adjacent ceiling structure.

At two end regions of the bearing surface, the bearing unit preferably has an upwardly-pointing limiting structure in each case. In this way, the risk of inadvertent detachment of the reflector as a result of leaving the bearing surface is markedly reduced.

The mounting ring preferably has an introducing groove which permits the introduction of the supporting unit from below. This allows the possibility of particularly simple mounting or suspension of the reflector on the mounting ring, particularly after the latter has been fixed to the ceiling element.

The supporting unit preferably has a number of supporting lugs, for example three. This permits secure, defined resting of the reflector on the mounting ring.

The bearing unit preferably has a number of bearing elements, for example three, each of said bearing elements being constructed for supporting one of the supporting lugs in each case.

The invention will be explained in greater detail below with the aid of an exemplified embodiment and with reference to the drawings, in which:

FIG. 1 shows a perspective view, obliquely from above, of an exemplary embodiment of a downlight according to the invention, and FIG. 2 shows a sectional representation of the said downlight in perspective.

Figure 1:
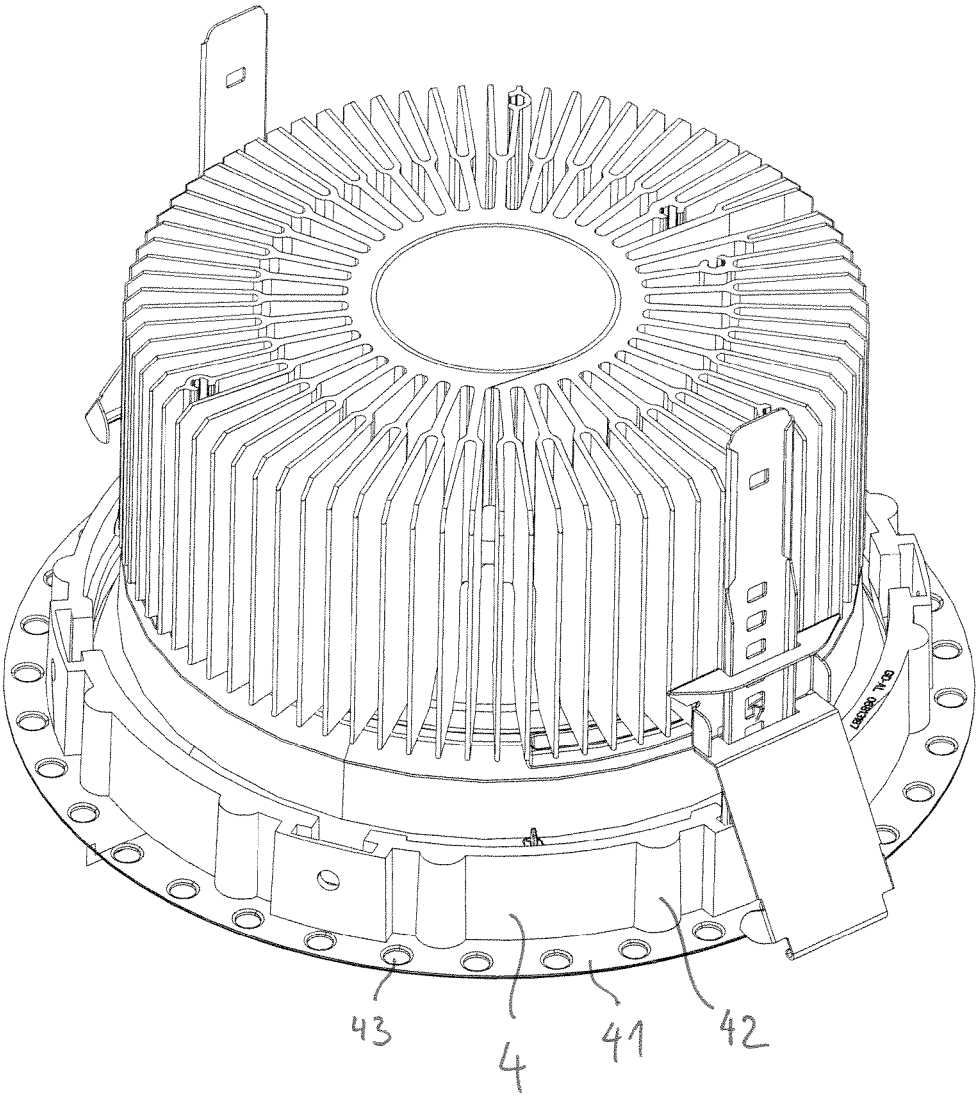
FIG. 1 shows a perspective view, obliquely from above, of the exemplified embodiment of a downlight according to the invention.

The downlight has a light source 2 which serves to generate a light to be emitted downwards by the downlight. The light source 2 may comprise an LED (light-emitting diode) and may, for example, be formed from a number of LED's.

The downlight is intended to be fastened to a ceiling element (not shown in the drawings). For this purpose, the downlight has a mounting ring 4 or "fitting ring" which serves to retain or fix the downlight on the ceiling element. In particular, the mounting ring 4 may have an outwardly-pointing structure 42 which is intended to be brought into bearing contact, from inside, against a circular aperture in the ceiling element. Moreover, the mounting ring 4 may have a flange 41 which is intended to be connected to the ceiling element from below, for example by means of a screw connection. Provision may also be made for the flange 41 to be intended to be connected to a rim region of the circular aperture from above, for example by means of a screw connection. For this purpose, the mounting ring 4 may have, in particular, apertures 43 which are intended to receive suitable connecting means, that is to say screws, for example.

Moreover, the downlight has a reflector 6 for reflecting the light generated by the light source 2. The word "reflector" therefore designates a component of the downlight which serves or is constructed—at least primarily—for reflecting the light emitted by the light source.

Figure 3:
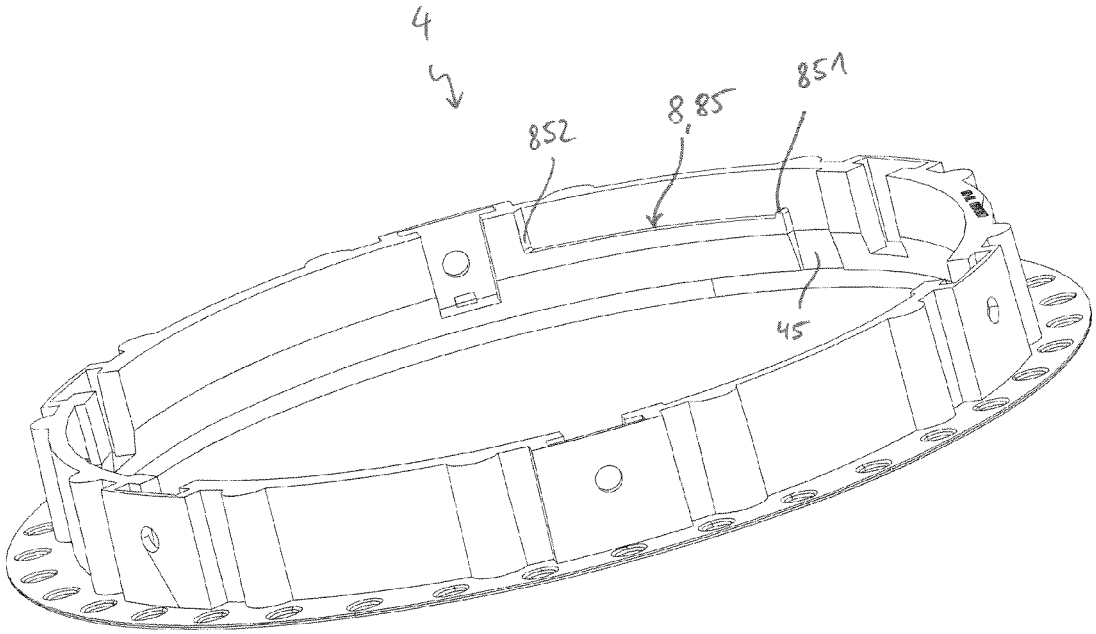
FIG. 3 shows a mounting ring belonging to the downlight, in separated form.

The reflector 6 is retained on the mounting ring 4 by a retaining device which will be described more precisely below. FIG. 3 shows the mounting ring 4 in separated form, FIG. 4 shows the reflector 6 and FIG. 5 shows a perspective view of the reflector 6 and mounting ring 4 without any other components of the downlight.

The retaining device is constructed in such a way that the reflector 6 is retained merely by resting on the mounting ring 4. In particular, therefore, no provision is made for a clamping or latching element which would fix or retain the reflector 6 in the position intended for operating purposes, in relation to the mounting ring 4 or any other component of the downlight, by clamping or latching. In this sense, the reflector 6 is suspended merely from the mounting ring 4.

The reflector 6 is therefore retained in its intended position for operation of the downlight, exclusively through the fact that it rests on the mounting ring 4. What is made possible in this way is that the reflector 6 can be separated from the mounting ring 4 without any pressure being exerted on the reflector 6.

Figure 4:
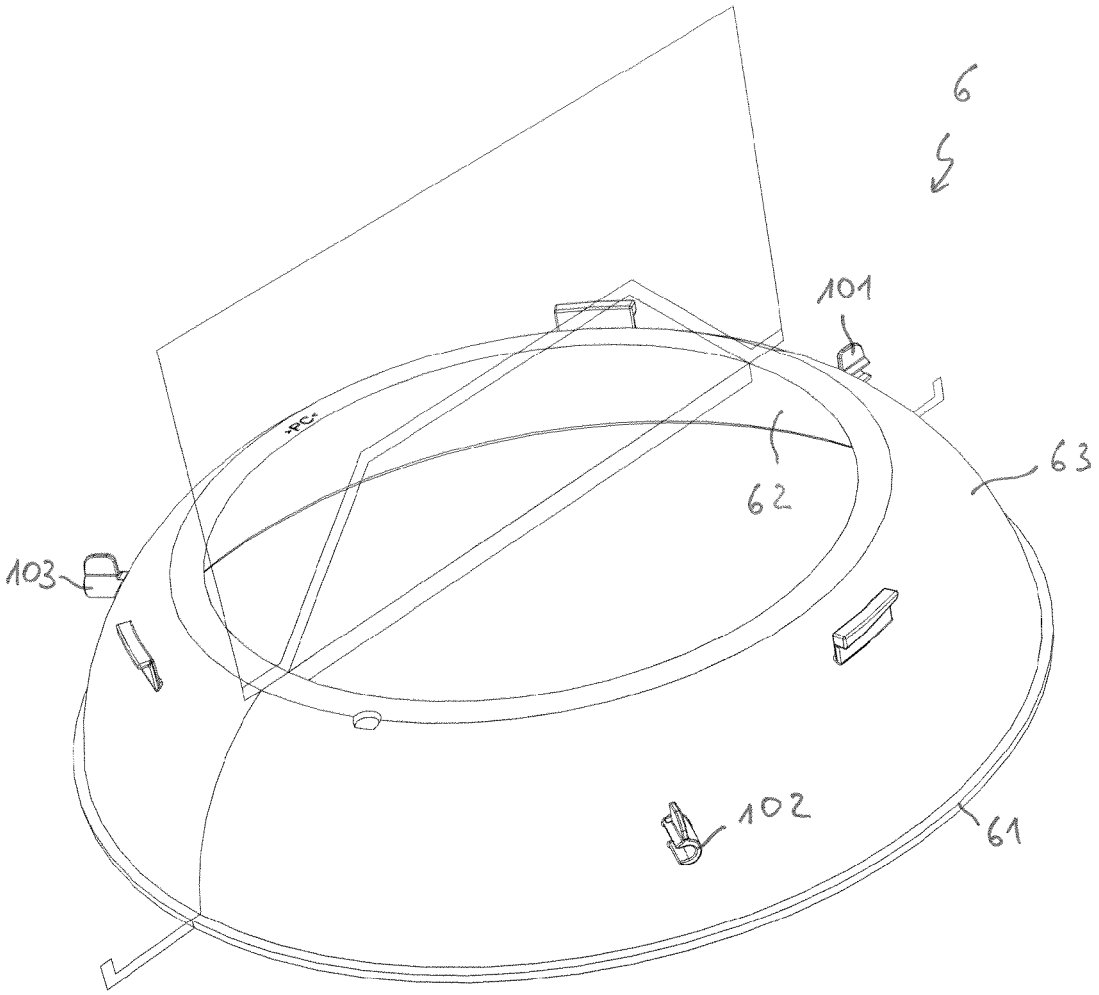
FIG. 4 shows the reflector of the downlight in separated form.
Figure 5:
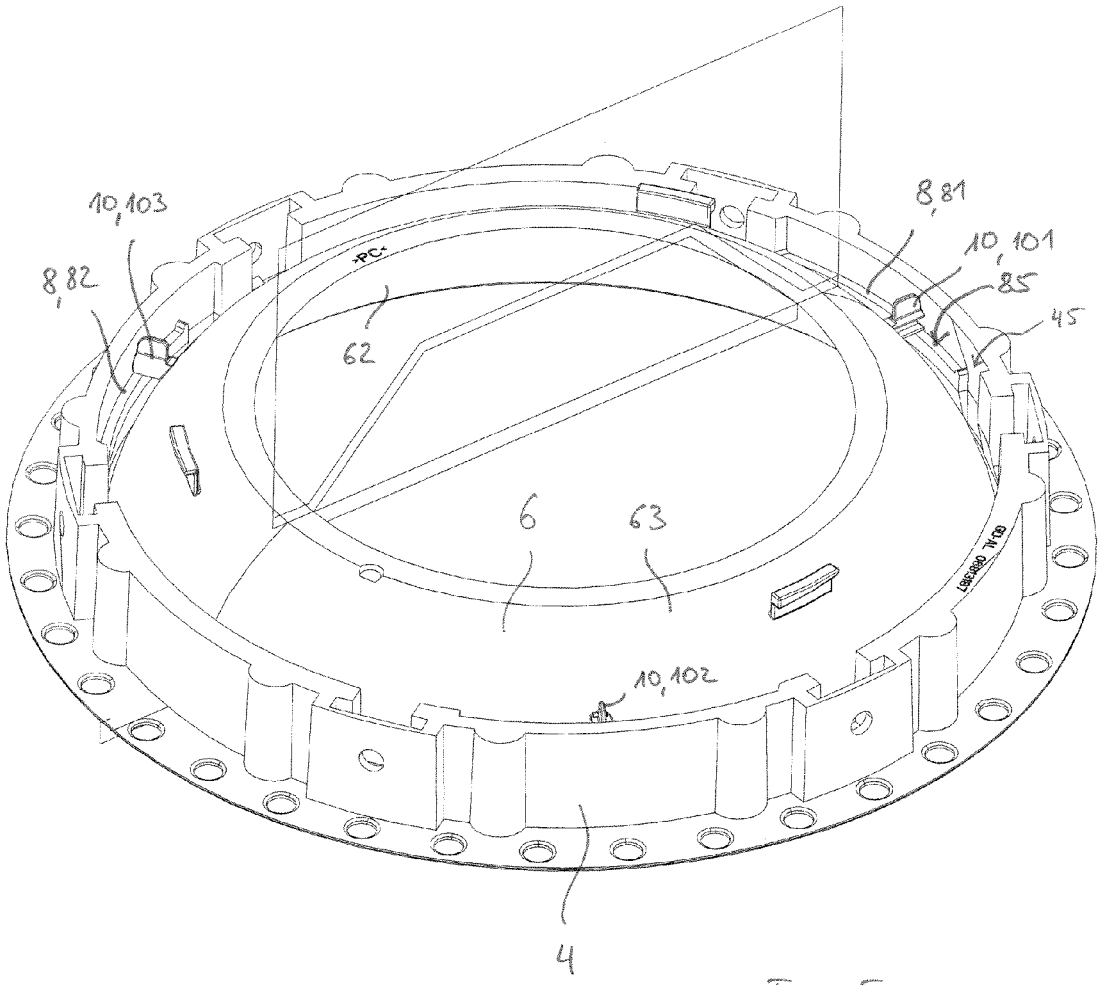
FIG. 5 shows a perspective view of the reflector and mounting ring, without any other components of the downlight.

In the exemplary embodiment shown, the reflector 6 has an inwardly-pointing reflecting surface 62, which is indicated on an exemplary basis in FIG. 4 and is constructed for reflecting the light originating from the light source 2, and also an outwardly-pointing outer surface 63. The reflector 6 can be lifted up for detachment from the rest of the downlight by direct support on the reflecting surface 62 from below, without there being any appreciable risk of damage to the reflector 6 in the process. In particular, therefore, the reflector 6 can be constructed without a broad flange, such as is provided, according to the prior art, for handling for the detaching operation.

Figure 2:
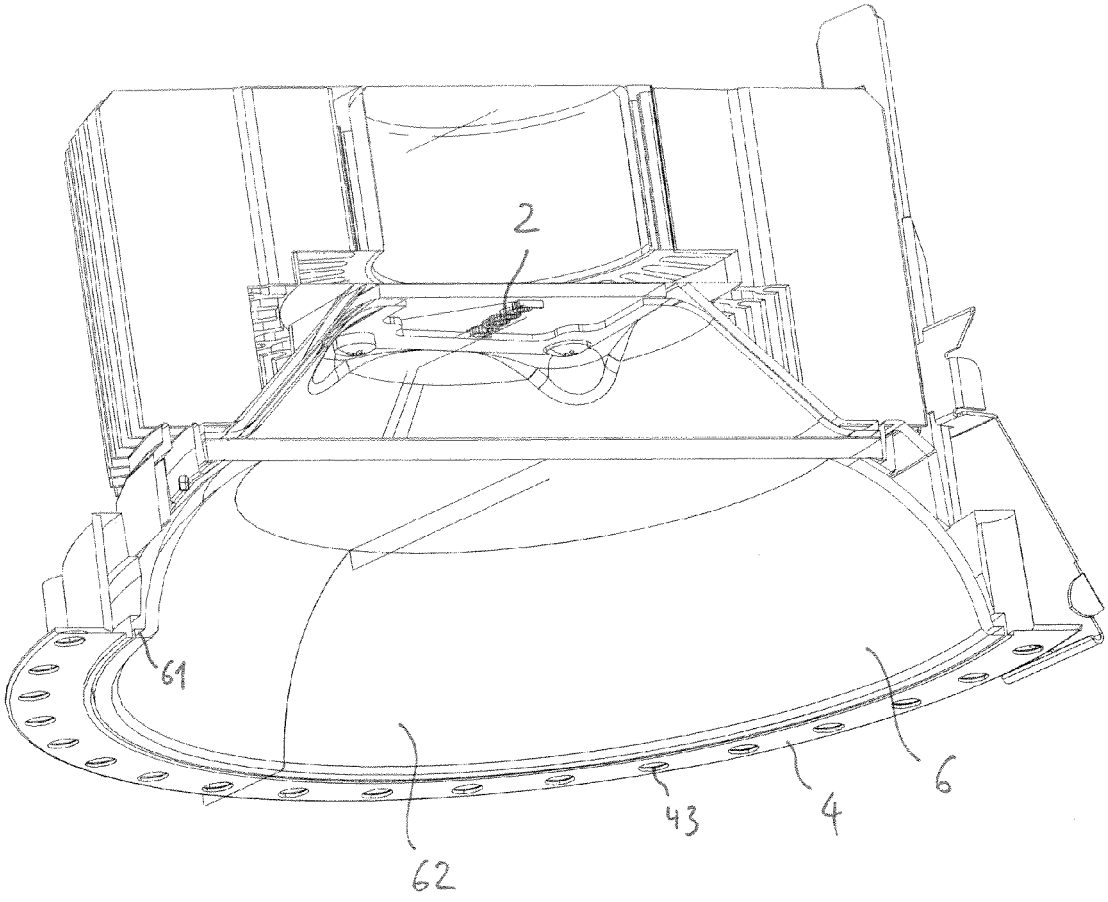
FIG. 2 shows a sectional representation of the downlight in perspective.

In the exemplified embodiment shown, the reflector 6 accordingly merely has a flange 61 of minimal construction which—as is apparent from FIG. 2 for example—merely serves for constructing a rim termination of the reflector 6 that has a neat appearance. Because of its minimal size, this flange 61 is unsuitable as a contact surface for handling the reflector 6 in the course of the detaching operation.

The downlight can therefore be configured in a "frameless" manner, so to speak, which improves the design possibilities for the outward appearance. Provision may be made, for example, for the flange 41 of the mounting ring 4 to be masked with plaster after the downlight has been installed.

The mounting ring 4 may, in particular, have a bearing unit 8, and the reflector 6 a supporting unit 10, in which case the bearing unit 8 and the supporting unit 10 constitute parts of the retaining device and the reflector 6 is retained on the mounting ring 4 through the fact that the supporting unit 10 rests on the bearing unit 8.

The supporting unit 10 may have a number of supporting lugs, for example three, 101, 102, 103. One bearing element 81, 82, in each case, may be provided for each of the supporting lugs 101, 102, 103, the bearing elements 81, 82 constituting parts of the bearing unit 8. In the exemplified embodiment shown, three supporting lugs 101, 102, 103 and three corresponding bearing elements are provided, in being possible to make out only two bearing elements 81, 82 in FIG. 5 because of the perspective.

The bearing unit 8 preferably has a bearing surface 85 for at least part of the supporting unit 10. For example, each of the bearing elements 81, 82 may have a bearing surface for one of the supporting lugs 101, 102, 103 in each case.

Under these circumstances, the bearing elements 81, 82 and the supporting lugs 101, 102, 103 are preferably of symmetrical construction, so the retaining device will be described in greater detail below only with reference to the supporting lug 101 and the corresponding bearing surface 85.

In this case, the retaining device is advantageously designed in such a way that the reflector 6 can be retained in a number of different positions relative to the mounting ring 4. As becomes apparent from FIGS. 3 and 5, the bearing surface 85 may have, for example, the shape of a segment of a circle, so that the reflector 6 can be retained in different positions, in relation to the mounting ring 4, which are produced when the reflector 6 is rotated about a vertical axis. The supporting lug 101 is able to slide on the bearing surface 85 when this rotation of the reflector 6 occurs.

Provision may particularly be made, as becomes clear on closer examination of FIG. 3, for the bearing surface 85 to have a slight inclination; in this connection, the inclination is, in particular, so slight that the reflector 6 does not slip when resting on the bearing unit 8 but maintains its location in relation to the mounting ring 4 because of friction. The inclination is preferably formed so as to be of the same shape or steepness over the entire bearing surface 85. For example, an inclination of less than 3° may be provided. What can be achieved by means of a bearing surface 85 of this kind is that the reflector 6 can be set at slightly different heights, relative to the mounting ring 4, by suitable rotation about the vertical axis. As a result of this, it is possible, for example, to compensate for manufacture-induced or installation-induced deviations from ideal values, after the downlight has been installed.

As is apparent from FIG. 3, the bearing unit 8 preferably has, at two end regions of the bearing surface 85, an upwardly-pointing limiting structure 851, 852 in each case. As a result of this, it is possible, in practice, to prevent the reflector 6 from slipping down from the bearing surface 85 and, in this way, being separated from the mounting ring 4 unintentionally. Accordingly, the limiting structures 851, 852 are preferably constructed in such a way that they serve as stops for the supporting lug 101 when a sliding movement of the latter on the bearing surface 85 occurs.

Moreover, the mounting ring 4 advantageously has an introducing or insertion groove 45 which permits the introduction of the supporting unit 10 or supporting lug 101. In turn, it is possible, in an analogous manner, to provide an introducing groove of corresponding construction for each of the supporting lugs 101, 102, 103.

The insertion groove 45 may be provided in a manner immediately adjacent to one of the two limiting structures—in FIG. 3, the limiting structure 851—the said limiting structure 851 being limited in its height in such a way that the reflector 6 can be introduced from below, by means of the supporting unit 10 or its supporting lug 101, through the introducing groove 45, can then be lifted over the limiting structure 851 and can finally be placed on the bearing surface 85. The other corresponding limiting structure 852 may—as is outlined in FIG. 3—be constructed so as to be higher, in particular so high that the reflector 6 cannot be lifted over it.

The invention claimed is:

1. A downlight having:

a light source for generating a light to be emitted downwards by the downlight;

a mounting ring for retaining the downlight on a ceiling element; and a reflector for reflecting the light generated by the light source, the reflector being retained on the mounting ring by a retaining device, wherein the retaining device is constructed in such a way that the reflector is retained merely by resting on the mounting ring such that once retained, the reflector merely has to be lifted up to detach from the mounting ring.

2. The downlight according to claim 1, in which the mounting ring has a bearing unit and the reflector has a supporting unit, the bearing unit and supporting unit being parts of the retaining device and the reflector being retained on the mounting ring through the fact that the supporting unit rests on the bearing unit.

3. The downlight according to claim 2, in which the bearing unit has a bearing surface for at least part of the supporting unit, and the retaining device is designed in such a way that the reflector can be retained in a number of different positions relative to the mounting ring.

4. The downlight according to claim 3, in which the bearing surface has a slight inclination, preferably of less than 3°.

5. The downlight according to claim 3, in which, at two end regions of the bearing surface, the bearing unit has an upwardly-pointing limiting structure in each case.

6. The downlight according to claim 2, in which the mounting ring has an introducing groove which permits the insertion of the supporting unit from below.

7. The downlight according to 2, in which the supporting unit has a number of supporting lugs.

8. The downlight according to claim 7, in which the bearing unit has a number of bearing elements, each of said number of bearing elements being constructed for supporting one of the supporting lugs in each case.

9. The downlight of claim 1, wherein the reflector is configured to be detached from the mounting ring by merely lifting the reflector without pressure being exerted onto the reflector from another component of the downlight.

10. The downlight of claim 1, wherein the retaining device does not include a latching element and a clamping element to retain the reflector on the mounting ring.

11. The downlight of claim 1, wherein, when the reflector is retained on the mounting ring, the reflector is unable to move in a first direction and is able to move in a second direction directly opposite of the first direction.

12. A downlight, comprising:

a light source for generating a light to be emitted downwards by the downlight;

a mounting ring having a bearing unit and an introducing groove, the mounting ring for retaining the downlight on a ceiling element; and a reflector having a supporting unit, the reflector for reflecting the light generated by the light source, the reflector being retained on the mounting ring by a retaining device including the bearing unit and the supporting unit such that the supporting unit rests on the bearing unit, wherein the retaining device is constructed in such a way that the reflector is retained merely by resting on the mounting ring, and wherein the introducing groove permits the insertion of the supporting unit from below.

13. A downlight, comprising:

a light source for generating a light to be emitted downwards by the downlight;

a mounting ring for retaining the downlight on a ceiling element; and a reflector for reflecting the light generated by the light source, the reflector being retained on the mounting ring by a retaining device, wherein the retaining device is constructed in such a way that the reflector is retained merely by resting on the mounting ring and is detached from the mounting ring by lifting and/or rotating the reflector from the mounting ring without requiring a lateral force.

* * * * *